US011437213B2

(12) United States Patent
Yang et al.

(10) Patent No.: US 11,437,213 B2
(45) Date of Patent: Sep. 6, 2022

(54) ELECTRON EMISSION SOURCE BASED ON GRAPHENE LAYER AND METHOD FOR MAKING THE SAME

(71) Applicants: Tsinghua University, Beijing (CN); HON HAI PRECISION INDUSTRY CO., LTD., New Taipei (TW)

(72) Inventors: Xin-He Yang, Beijing (CN); Peng Liu, Beijing (CN); Shou-Shan Fan, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/899,794

(22) Filed: Jun. 12, 2020

(65) Prior Publication Data

US 2021/0193425 A1 Jun. 24, 2021

(30) Foreign Application Priority Data

Dec. 24, 2019 (CN) ..... 201911351457.6

(51) Int. Cl.
*H01J 9/02* (2006.01)
*H01J 3/02* (2006.01)

(52) U.S. Cl.
CPC ..... *H01J 9/025* (2013.01); *H01J 3/021* (2013.01); *H01J 2201/30461* (2013.01)

(58) Field of Classification Search
CPC ..... H01J 3/021
See application file for complete search history.

(56) References Cited

U.S. PATENT DOCUMENTS

2015/0206694 A1* 7/2015 Liu ..... H01J 29/04 257/10

FOREIGN PATENT DOCUMENTS

| | | |
|---|---|---|
| CN | 104011891 | 8/2014 |
| CN | 105448621 | 3/2016 |

* cited by examiner

*Primary Examiner* — Joseph L Williams
(74) *Attorney, Agent, or Firm* — ScienBiziP, P.C.

(57) ABSTRACT

An electron emission source is provided. The electron emission source includes a first electrode, an insulating layer, and a second electrode. The first electrode, the insulating layer, and the second electrode are successively stacked with each other. the second electrode is a graphene layer, and the graphene layer is an electron emission end to emit electron. A thickness of the graphene layer ranges from about 0.1 nanometers to about 50 nanometers.

9 Claims, 2 Drawing Sheets

ELECTRON EMISSION SOURCE BASED ON GRAPHENE LAYER AND METHOD FOR MAKING THE SAME

This application claims all benefits accruing under 35 U.S.C. § 119 from China Patent Application No. 201911351457.6, filed on Dec. 24, 2019, in the China National Intellectual Property Administration, the contents of which are hereby incorporated by reference. The application is also related to applications entitled, "ELECTRON EMISSION SOURCE AND METHOD FOR MAKING THE SAME", filed Jun. 12, 2020 Ser. No. 16/899,788.

FIELD

The present disclosure relates to an electron emission source and method thereof.

BACKGROUND

The electron emission source in the electron emission display device has two types: hot cathode electron emission source and cold cathode electron emission source. The cold cathode electron emission source comprises surface conduction electron-emitting source, field electron emission source, and metal-insulator-metal (MIM) electron emission sources.

In MIM electron emission source, the electrons need to have sufficient electron average kinetic energy to escape through the upper electrode to a vacuum. However, in conventional MIM electron emission source, the barrier is often higher than the average kinetic energy of electrons. As a result, the electron emission in the electron emission device is low.

BRIEF DESCRIPTION OF THE DRAWINGS

Implementations of the present technology will now be described, by way of embodiments, with reference to the attached figures.

DETAILED DESCRIPTION

Figure 1:
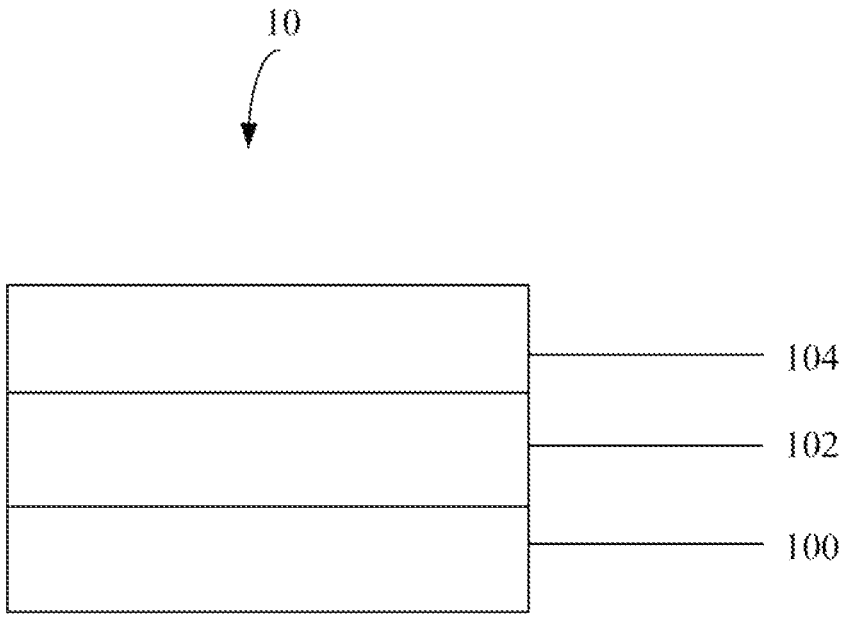
FIG. 1 shows a schematic view of one embodiment of an electron emission source.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one".

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to illustrate details and features of the present disclosure better.

Several definitions that apply throughout this disclosure will now be presented.

The term "comprise" or "comprising" when utilized, means "include or including, but not necessarily limited to"; it specifically indicates open-ended inclusion or membership in the so-described combination, group, series, and the like.

Referring to FIG. 1, an electron emission source 10 according to one embodiment is provided. The electron emission source 10 comprises a first electrode 100, an insulating layer 102, and a second electrode 104. The first electrode 100, the insulating layer 102, and the second electrode 104 are successively stacked with each other. The second electrode 104 is a graphene layer. The graphene layer is an electron emission end to emit electron.

The first electrode 100 is a conductive metal film. The material of the first electrode 100 is copper, silver, iron, cobalt, nickel, chromium, molybdenum, tungsten, titanium, zirconium, hafnium, vanadium, niobium, tantalum, aluminum, magnesium, or metal alloy. A thickness of the first electrode 100 ranges from about 10 nanometers to about 100 micrometers. In one embodiment, the thickness of the first electrode 100 ranges from about 10 nanometers to about 50 nanometers. In another embodiment, the first electrode 100 is a copper metal film with a thickness of about 100 nanometers.

The insulating layer 102 is disposed on a surface of the first electrode 100, and the second electrode 104 is disposed on a surface of the insulating layer 102 away from the first electrode 100. That is, the insulating layer 102 is disposed between the first electrode 100 and the second electrode 104. In one embodiment, the insulating layer 102 is in directly contact with the first electrode 100 and the second electrode 104.

The material of the insulating layer 102 is alumina, silicon nitride, silicon oxide, tantalum oxide, boron nitride, or other materials. The thickness of the insulating layer 102 ranges from about 0.1 nanometers to about 5 nanometers. In one embodiment, the material of the insulating layer 102 is boron nitride, and the thickness of the insulating layer 102 ranges from about 0.3 nanometers to about 0.6 nanometers.

The second electrode 104 is a graphene layer. The graphene layer comprises at least one graphene film. The graphene film, namely a single-layer graphene, is a single layer of continuous carbon atoms. The single-layer graphene is a nanometer-thick two-dimensional analog of fullerenes and carbon nanotubes. When the graphene layer comprises a plurality of graphene films, the plurality of graphene films can be stacked on each other or arranged coplanar side by side. The thickness of the graphene layer is in a range from about 0.1 nanometers to about 50 micrometers. For example, the thickness of the graphene layer can be 1 nanometer, 10 nanometers, 20 nanometers, or 50 nanometers. In one embodiment, the thickness of the graphene layer is in a range from about 0.1 nanometers to about 10 micrometers. The graphene layer can consist of one single-layer graphene, the single-layer graphene has a thickness of one single carbon atom. That is, the thickness of the graphene film is a diameter of one single carbon atom. In one embodiment, the graphene layer is a pure graphene structure consisting of graphene. Because the single-layer graphene has great conductivity, the electrons can be easily collected, and the electrons can quickly escape through the graphene layer and become emitted electrons.

The electron emission source 10 can be disposed on a surface of a substrate, and the first electrode 100 is disposed on the surface of the substrate. The substrate is used to support the electron emission source 10. The material of the substrate can be selected from rigid materials or flexible materials. The rigid materials can be glass, quartz, ceramics, diamond, or silicon wafers. The flexible materials can be plastics and resins.

The electron emission source 10 works in a direct current (DC) driving mode. The working principle of the electron emission source 10 is as follows: when the direct current is applied to the electron emission source 10, an electric field is formed in the insulating layer 102, and electrons are emitted from the first electrode 100 and passed through the insulating layer 102 by tunneling effects, and are accelerated to the graphene layer by the electric field in the insulating layer 102. Because the insulating layer 102 has a small thickness, the energy loss of the electrons during the movement is reduced. The graphene layer also has a small thickness, and the electrons may quickly escape through the graphene layer and become emission electrons, thereby the emission current may be increased. Therefore, the electron emission rate may be improved.

In one embodiment, the electron emission source 10 consists of a copper electrode, a boron nitride layer, and a graphene layer. When the direct current is applied to the electron emission source 10, a electric field is formed in the boron nitride layer and the electrons are emitted from the copper electrode. When the electron energy is greater than the work function of the boron nitride layer, the electrons pass through the boron nitride layer by tunneling effects, and are accelerated to the graphene layer by the electric field in the boron nitride layer. Because the insulating layer also has a small thickness, in a range from about 0.3 nanometers to about 0.6 nanometers, the energy loss of the electrons during the movement may be reduced. The graphene layer has a thickness of one single carbon atom, the electrons may be quickly emitted from the graphene layer, thereby the emission current may be increased and the electron emission rate improved.

Figure 2:
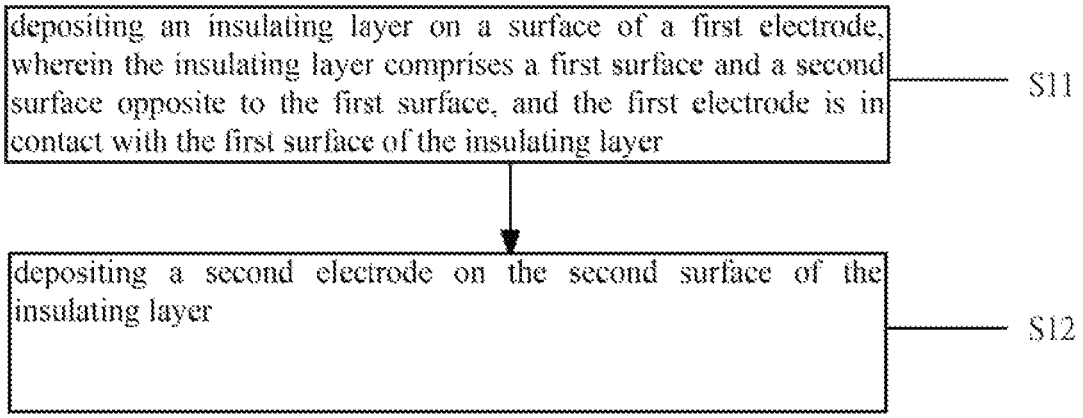
FIG. 2 is a flowchart of one embodiment of a method for making the electron emission source.

Referring to FIG. 2, a method of one embodiment of making electron emission source 10. The method comprises:

(S11) depositing an insulating layer 102 on a surface of a first electrode 100, wherein the insulating layer 102 comprises a first surface and a second surface opposite to the first surface, and the first electrode 100 is in contact with the first surface of the insulating layer 102; and (S12) depositing a second electrode 104 on the second surface of the insulating layer 102.

At block S11, the first electrode 100 may be formed by a magnetron sputtering method, a vapor deposition method, or an atomic layer deposition method. In one embodiment, the first electrode 100 is a copper metal film formed by the vapor deposition method, and the thickness of the first electrode 100 is about 100 nanometers.

The insulating layer 102 is formed by a magnetron sputtering method, a vapor deposition method, or an atomic layer deposition method. In one embodiment, the insulating layer 102 is a boron nitride layer, the boron nitride layer is formed by the vapor deposition method, and the thickness of the boron nitride layer ranges from about 0.3 nm to about 0.6 nm.

At block S13, the second electrode 104 consists a graphene layer. The graphene layer can be prepared and transferred to a surface of the insulating layer 102 away from the first electrode 100 by graphene powder or a graphene film. The graphene powder has a film shape after being transferred to the second surface of the insulating layer 102. The graphene film can also be prepared by chemical vapor deposition (CVD) method, a mechanical peeling method, electrostatic deposition method, a silicon carbide (SiC) pyrolysis, or epitaxial growth method. The graphene powder can be prepared by a liquid phase separation method, an intercalation stripping method, a cutting carbon nanotubes, a preparation solvothermal method, or an organic synthesis method.

In one embodiment, the graphene layer is one graphene film. The graphene film, namely a single-layer graphene, is a single layer of continuous carbon atoms. The single-layer graphene is a nanometer-thick two-dimensional analog of fullerenes and carbon nanotubes. The graphene layer consists of one single-layer graphene, the single-layer graphene has a thickness of a single carbon atom. That is, the thickness of the graphene film is a diameter of one single carbon atom.

The electron emission source formed by this method has the following beneficial characteristics. The electron emission source 10 works in a direct current (DC) driving mode. The working principle of the electron emission source 10 is: when the direct current is applied to the electron emission source, an electric field is formed in the insulating layer, and the electrons are emitted from the first electrode and passed through the insulating layer by a tunneling effect, and are accelerated to the graphene layer by the electric field in the insulating layer. Because the insulating layer has a small thickness, the energy loss of the electrons during the movement is relatively small. The graphene layer also has a small thickness, and the electrons can quickly escape through the graphene layer and become emission electrons, which can increase the emission current. Therefore, the electron emission rate can be improved.

Even though numerous characteristics and advantages of certain inventive embodiments have been set out in the foregoing description, together with details of the structures and functions of the embodiments, the disclosure is illustrative only. Changes may be made in detail, especially in matters of arrangement of parts, within the principles of the present disclosure to the full extent indicated by the broad general meaning of the terms in which the appended claims are expressed.

Depending on the embodiment, certain of the steps of methods described may be removed, others may be added, and the sequence of steps may be altered. It is also to be understood that the description and the claims drawn to a method may comprise some indication in reference to certain steps. However, the indication used is only to be viewed for identification purposes and not as a suggestion as to an order for the steps.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An electron emission source, comprising a first electrode, an insulating layer, and a second electrode successively stacked in a said order, the second electrode is a graphene layer, a thickness of the graphene layer ranges from approximately 0.1 nanometers to approximately 50 nanometers, and the graphene layer defines an electron emission end to emit electrons.

2. The electron emission source of claim 1, wherein the graphene layer comprises at least one graphene film, the graphene film consists of a single-layer graphene.

3. The electron emission source of claim 1, wherein the graphene layer consists of a single-layer graphene, and the single-layer graphene has a thickness of one single carbon atom.

4. The electron emission source of claim 1, wherein a material of the insulating layer is alumina, silicon nitride, silicon oxide, tantalum oxide, or boron nitride.

5. The electron emission source of claim 4, wherein the material of the insulating layer is boron nitride, and a thickness of the insulating layer ranges from approximately 0.3 nanometers to approximately 0.6 nanometers.

6. The electron emission source of claim 1, wherein the electron emission source consists of the first electrode, a boron nitride layer, and the graphene layer successively stacked in the said order.

7. A method for making an electron emission source, comprising:

depositing an insulating layer on a surface of a first electrode, wherein the insulating layer comprises a first surface and a second surface opposite to the first surface, and the first electrode is in contact with the first surface of the insulating layer; and depositing a second electrode on the second surface of the insulating layer, wherein the second electrode is a graphene layer, a thickness of the graphene layer ranges from approximately 0.1 nanometers to approximately 50 nanometers, and the graphene layer defines an electron emission end to emit electrons.

8. The method of claim 7, wherein the graphene layer consists of a single-layer graphene, and the single-layer graphene has a thickness of one single carbon atom.

9. The method of claim 8, wherein the material of the insulating layer is boron nitride, and a thickness of the insulating layer ranges from approximately 0.3 nanometers to approximately 0.6 nanometers.

* * * * *